US006854497B2

(12) United States Patent
White et al.

(10) Patent No.: US 6,854,497 B2
(45) Date of Patent: Feb. 15, 2005

(54) CONCENTRIC TAPE APPLICATOR

(75) Inventors: Paul White, Newmarket (CA); Michael Marshall, Richmond Hill (CA); Andrew Blackmore, King City (CA)

(73) Assignee: Roteq Machinery, Inc., Concord (CA)

( * ) Notice: Subject to any disclaimer, the term of this patent is extended or adjusted under 35 U.S.C. 154(b) by 23 days.

(21) Appl. No.: 10/435,896

(22) Filed: May 11, 2003

(65) Prior Publication Data

US 2004/0221961 A1 Nov. 11, 2004

(51) Int. Cl.[7] ..... B32B 35/00; B65H 75/30; B65H 23/182; B65H 59/04; B65H 77/00

(52) U.S. Cl. ..... 156/363; 156/543; 242/397.5; 242/415.1; 242/419.9; 242/420.4; 242/554.5

(58) Field of Search ..... 156/350, 351, 156/361–364, 538, 543, DIG. 28, DIG. 33; 242/397.5, 415.1, 419.7, 419.8, 419.9, 420.4, 554, 554.4, 554.5

(56) References Cited

U.S. PATENT DOCUMENTS 4,411,721 A * 10/1983 Wishart ..... 156/73.1
5,581,139 A * 12/1996 Toukola ..... 310/105
6,571,849 B2 * 6/2003 Erickson et al. ..... 156/523

* cited by examiner

*Primary Examiner*—Chris Fiorilla
*Assistant Examiner*—Sing Po Chan
(74) *Attorney, Agent, or Firm*—Myron Greenspan, Esq.; Lackenbach Siegel LLP

(57) ABSTRACT

A concentric tape applicator has a support shaft that defines an axis and includes a structure for supporting a tape pad for rotation with the support shaft about the axis. Guide rollers are mounted on the support shaft for rotation concentrically about the axis for guiding tape from the tape pad for application to an elongated member advancing along the axis relative to the support shaft. A drive is directly coupled to the guide elements. A differential clutch is provided that has an input shaft directly coupled to the drive and an output shaft coupled to the support shaft for applying braking forces to the pad. A feedback circuit is provided for sensing the speed of rotation of the pad and applying a feedback signal to the clutch for regulating the excitation of the clutch to maintain a substantial uniform tension on the tape dispensed from the pad so potentially independently of the amount of tape remaining on the pad.

19 Claims, 7 Drawing Sheets

FIG. 4A
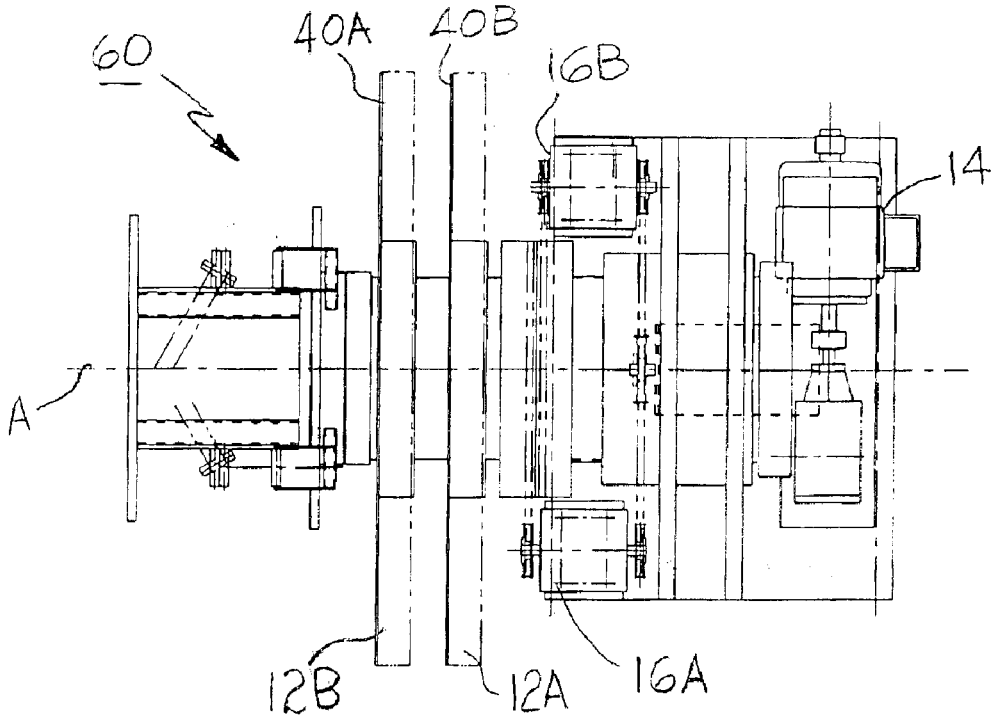
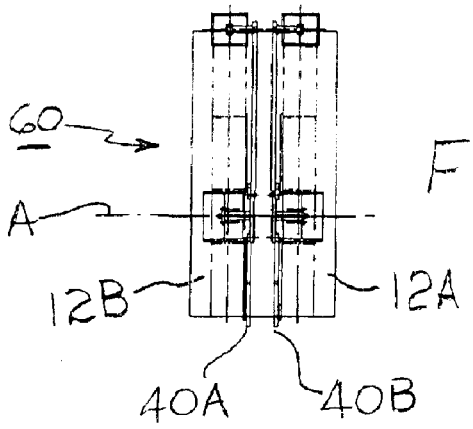
FIG. 4B

CONCENTRIC TAPE APPLICATOR

BACKGROUND OF THE INVENTION

1. Field of the Invention

The present invention relates to a tape-winding machine. More specifically, the present invention relates to a tensioning system for a concentric taping apparatus.

2. Description of the Related Art

Taping machines have been devised for applying tape about numerous products and product packages. Tape is applied to packages as they are advanced in a production line generally along the axis of the rotating machinery. The size and the nature of the tape will differ for different applications. Currently, some of the important factors and considerations in the design and the use of such taping machinery include the production output efficiency, the quality and consistency of the resulting product, the ease of replenishing tape that has been dispensed, and other factors that are well-known to those skilled in the art.

During use, the tape is applied in tension to the packages. One of the more significant problems that arise with taping machines is the ability to maintain a uniform tension in the tape as it is dispensed. Fluctuations in tape tension are affected both by the perfection in the tape pad and the package itself, as well as fluctuations and the rotational speeds of the various components, including the taping head.

Another attribute of conventional taping machines is that the tape tension tends to fluctuate between the time when the tape package is full and the tape is removed from a package having a greater diameter, to when the tape package is almost depleted when the tape is removed from such package having a smaller diameter. The constant change in the diameter of the package frequently contributes to differences in tension in the tape itself. Several types of braking mechanisms have been proposed in order to compensate or adjust the tension on the tape in an effort to maintain a substantially constant tension throughout the taping cycle.

The use of various mechanical brakes to control tension, such as disk brakes and band brakes, has important disadvantages. The use of friction-type mechanical braking components on machines that rotate at very high speeds has proven difficult to control and are inconsistent. Such attempts have not provided results that are entirely reliable, particularly at very high speeds. Since, in some instances, the tape pads can rotate as high as 1800 rpm, the centrifugal and centripetal forces have an adverse effect, even on electromagnetic units. However, even when using such mechanical or electromagnetic units, some sensing device must be used to sense the diameter of the tape packages at any given time so that the output of such sensor can be used in some way to compensate for the changes in tension.

Typically, optical sensors and ultrasonic sensors have been used to keep track of a tape roll's diameter. Here, again the results have been inconsistent and spikes have been observed in the tension of the tape because of the high speeds of rotation of mechanical parts, as well as because the use of optical sensors in dusty environments create operational difficulties. In electronic control systems, when tension spikes occur in the control signals they must be filtered out. Where conventional types of slip rings are used in a taping machine providing a control to compensate for tension spikes other inherent deficiencies result.

One tape applicator system has been proposed by Thermo Plastic Engineering Corporation (TEC"), which does not rely on mechanical brakes. In the TEC system the tape pad is driven directly by the main drive. The drive arm or guide system, or the tape head, is driven through a differential clutch, while the tape pad is driven directly by a main drive.

The output shaft of the clutch should preferably be connected to the low inertia components. However, in the TEC system, the output shaft of the clutch is connected to the high inertia guidance system or tape head. The output clutch is also coupled to an encoder, the output of which is connected to a control circuit that applies a control signal to the main drive. The output of the control circuit changes or adjusts the speed of the high inertia main drive and this tends to complicate the rest of the line as well as control over the main drive. Consequently, while the TEC system utilizes a differential clutch and avoids the use of mechanical braking components, the system introduces additional complications and shortcomings.

SUMMARY OF SELECTED EMBODIMENTS OF THE INVENTION

In order to overcome the disadvantages inherent in the prior art tape applicator machinery, it is an object of the present invention to provide a tape applicator machine that eliminates the disadvantages and shortcomings of the related art machinery reviewed above.

It is another object of the invention to provide a tape applicator machinery that is simple in construction and economical to manufacture.

It is still another object of the invention to provide a tape applicator that eliminates the use of slip rings.

It is yet another object of the invention to provide a tape applicator that eliminates the use of optical or ultrasonic sensors to determine the quantity of tape used from a given tape pad and, therefore, the diameter of the tape pad at any given time.

It is a further object of the invention to provide a tape applicator, as in the previous objects, that is not susceptible to centrifical force variation and is not adversely affected by such forces during high-speed rotation.

It is still a further object of the invention to provide a tape applicator that utilizes clutches, in one embodiment a differential clutch, where the input shaft of the clutch is coupled to the high inertia components, and the output shaft of the clutch is coupled to the low inertia components of the system.

It is yet a further object of the invention to provide a tape applicator, of the type under discussion that can accommodate two or more tape pads in simultaneous use.

It is yet a further object of the invention to provide a tape applicator as in the previous objects that they can be used with both hollow as well as solid supporting shafts.

It is an additional object of the invention to provide a tape applicator that further includes selectively movable tape application rollers that can move to retracted positions when taping is not to taking place and moved radially inwardly towards an elongated objected to be taped during taping, thus providing the possibility of continuous taping.

It is an additional object of the invention to provide a tape guide system that floats or is driven into position as the taping head accelerates or decelerates. The running position can remain floating or can be clamped, thus providing the possibility of continuous taping.

In order to achieve the above objects, as well as others, which will become apparent hereafter, a concentric tape applicator in accordance with the present invention comprises a support shaft defining an axis and including means for supporting a tape pad for rotation with the support shaft about the axis. Guide means is provided mounted on the support shaft for rotation concentrically about the axis for guiding tape from the tape pad for application to an elongated member advancing along the axis relative to the support shaft. A drive is provided that directly couples to the guide means. A differential clutch has an input shaft directly coupled to the drive and an output shaft coupled to the support shaft for applying braking forces to the pad. Feedback means is provided for sensing speed of rotation of the pad and applying a feedback signal to the clutch to maintain the substantially uniform tension on the tape dispensed from the pad substantially independently of the amount of tape remaining in the pad.

In accordance with another feature of the invention, two or more tape pads may be provided, each of which can have its tension independently adjusted by means of associated differential clutches and feedback systems.

BRIEF DESCRIPTION OF THE DRAWINGS

Other aspects, objects and advantages of the present invention will become apparent upon reading of the following detailed description of the preferred embodiment of the present invention when taken in conjunction with the drawings, as follows:

FIG. 4A is a top plan view of a tape applicator in accordance with the present invention in which two tape pads are provided;

FIG. 4B is a partial side view of the tape heads of a tape applicator in accordance with the present invention in which two tape pads are provided;

DETAILED DESCRIPTION OF SELECTED EMBODIMENTS

Figure 1:
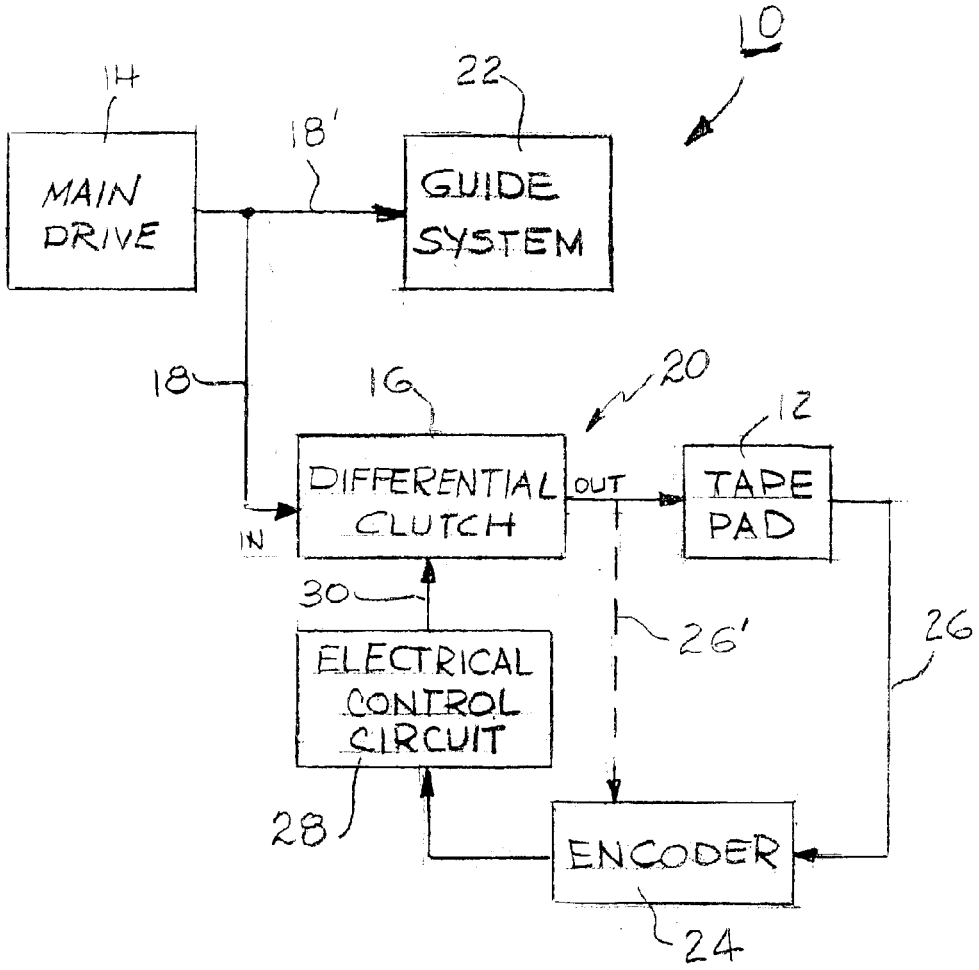
FIG. 1 is a block diagram generally depicting an applicator in accordance with the present invention and depicts the primary coupling links used in the applicator.

We refer now specifically to the figures, in which similar or identical parts will be designated by the same reference numerals throughout, and first referring to FIG. 1, a tape applicator 10 is generally depicted in block diagram showing the mechanical coupling links between the components of the system. A main and machine drive 14 is directly coupled to a differential clutch 16 by means of coupling or link 18. The main drive 14 is also directly coupled to a guide system 22 (or tape head 22) by means of a coupling or link 18' for paying off of the tape from the tape pad 12. The removal of the tape from tape pad 12 includes the actions of the linked guide system 22, which causes the tape pad 12 of the package to rotate, and such rotation is coupled to the other shaft of the differential clutch 16.

The specific differential clutch used is not critical. A magnetic particle clutch sold under the mark "MAGPOWR"®, for example, may be used. Such a clutch includes two mechanical shafts. One connected to a rotor and the other connected to a drive cylinder. A coil is provided to which a current may be applied. The field created in the coil passes through the drive cylinder and electro magnetically couples the rotor to the drive cylinder. As the current to the coil is increased coupling increases between the drive cylinder and the rotor. Such coupling, or torque capacity, is proportional to the amount of current in the coil. With no current in the clutch the load is not connected to the drive. Increased currents create more torque-ability in the clutch and this torque is delivered to the load. The clutch, therefore, acts as a valve, allowing any amount of torque to be passed to the load, the coil and its magnetic field acting as a valve for controlling the extent of the torque coupled into the input drive to drive the output rotor shaft.

In accordance with the present invention, clutch 16 is so arranged that the drive is till, and the shaft connected to the drive cylinder which acts as the input shaft directly coupled to main drive 14 and the rotor output shaft is coupled with the tape pad 12. Since the guide system or tape head 22 generally represents a much higher moment of inertia than the moment of inertia of the tape head 22, clutch 16 is preferably arranged so that the rotor shaft of the clutch is connected to the low inertia side of the system while the high inertia side of the system is coupled to the drive cylinder shaft or input shaft of clutch 16 in order to provide a suitable control current for the coil of clutch 16.

An encoder 24 (or encoders 24) is directly coupled with tape pad 12 or to the output shaft of the clutch 16, as represented by the couplings or links 26, 26' respectively. In both cases, encoder 24 directly derives information regarding the rotational speed of tape pad 12. The actual control of voltage or current delivered to the clutch coil is provided by an electrical control circuit 28 that converts the rotational speed information to control voltage 30 applied to the coil of clutch 16.

Encoders 24 and electrical control circuits 28, that typically include software implementations, are well known to those skilled in the art and will not be described here in more detail. It will be clear that once the RPM of the tape pad is establish, by encoder 24, this information can be converted to provide the information regarding the diameter of the tape package and/or the diameter of the tape package that remains at any given point in time. Such information, in turn, can be used, by electronic control circuit 28, to produce the required excitation current needed for application to the coil of clutch 16 in order to compensate for the speed and other variable factors, thereby maintaining the tension in the tape at a substantially constant value, irrespective of the numerous factors that may fluctuate in tape applicator 10. Consequently, this system provides a precise and uniform tensioning system that is virtually immune to the fluctuations and variations in the various parameters defining the tape system.

Figure 2:
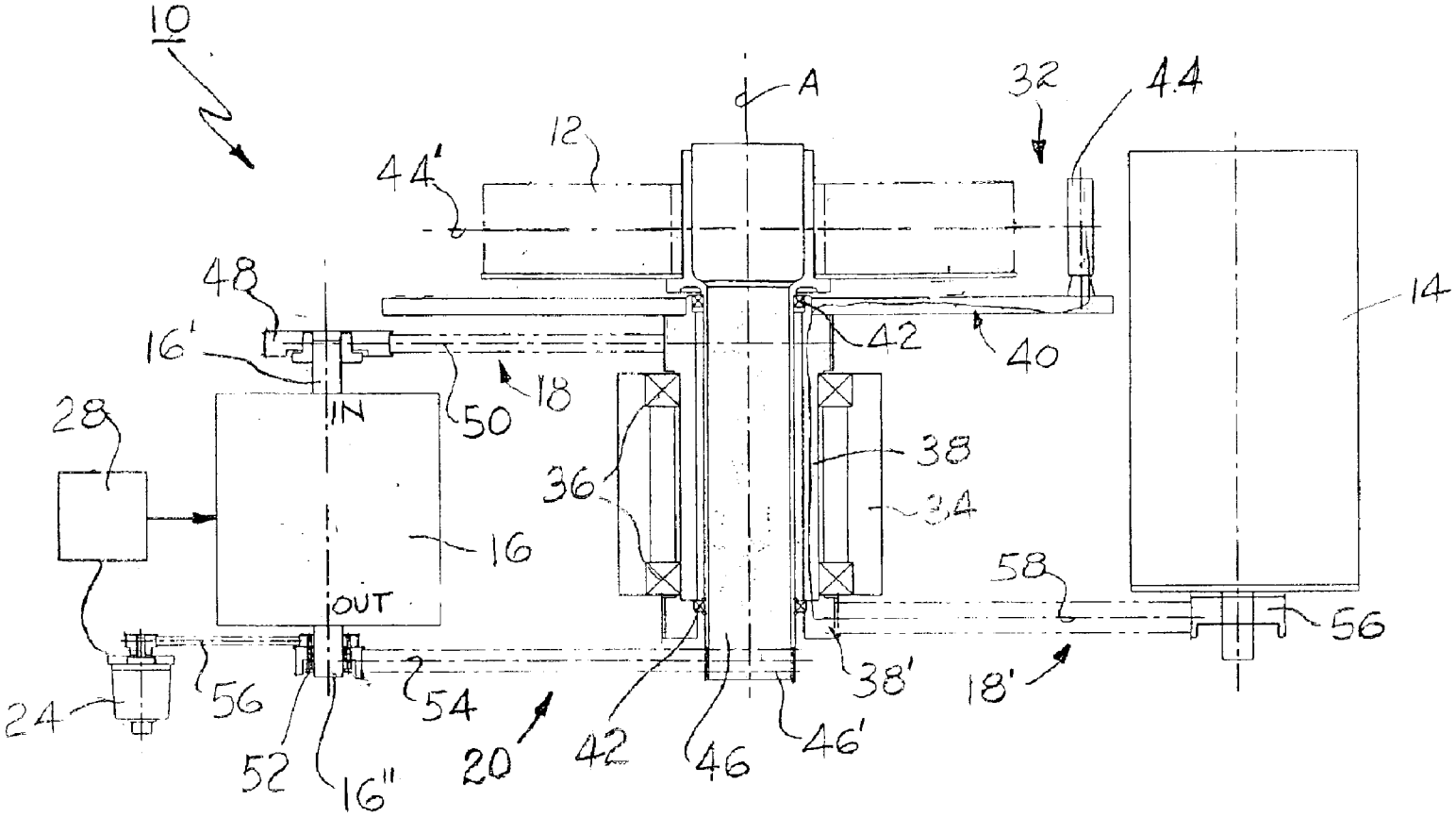
FIG. 2 is a schematic diagram of a tape applicator drive arrangement in accordance with the present invention for dispensing tape from a single tape pad.

Additionally, referring now to FIG. 2, physical realization of the system shown in FIG. 1 is illustrated diagrammatically. A head 32 (alternatively a rotor 32) is rotatably mounted about an axis A on a fixed frame 34 by means of bearings 36. Head 32 includes a hollow shaft 38 rotatably supported on bearings 36 and is provided with a pulley 38' at one end and a generally high inertia rotor 40 and that supports a tape guide or roller 44 arranged for rotation within the same or common rotation plane 44' on bearings 42 on which the tape pad 12 rotates.

Tape pad 12 is fixedly mounted at one end of a support shaft 46 while the opposing end of support shaft 46 is provided with a pulley 46'.

As described in connection with FIG. 1, main drive motor 14 is coupled by means of coupling or link 18' to the head, tape head or rotor 32 by means of a sheave 56', the coupling or link 18' being in the form of a belt 58 to provide a direct coupling between main drive motor 14 and tape head 32. Tape head 32 is also directly coupled to input shaft 16' of clutch 16 by means of a sheave 48 and link 18 that is in the form of a drive belt 50. Output shaft 16" of clutch 16 is coupled to support shaft 46 by means of sheave 52 and coupling 20 is also shown in a form including a belt 54.

Therefore, as indicated, both tape head 32 as well as the input shaft clutch are directly linked or coupled to the main motor drive 14. The support shaft 46, however, is directly linked to output shaft 16" of clutch 16, so that the speed of rotation of support shaft 46 also provides information with regard to the speed of rotation of tape pad 12 and, therefore, the extent of tape that is left on the tape package, as well as the calculated diameter of tape that remains.

This information is communicated to encoder 24 by means of coupling or link 56. Thus, encoder 24 is provided and linked with precise information regarding the speed of rotation of tape pad 12, as well as the amount of tape that has been used from that pad. In this way the braking force applied by output shaft for 16" coupled to support shaft 46 and, therefore, also on tape pad 12, can be adjusted by the feedback arrangement including encoder 24 and electronic circuit 28.

Figure 3:
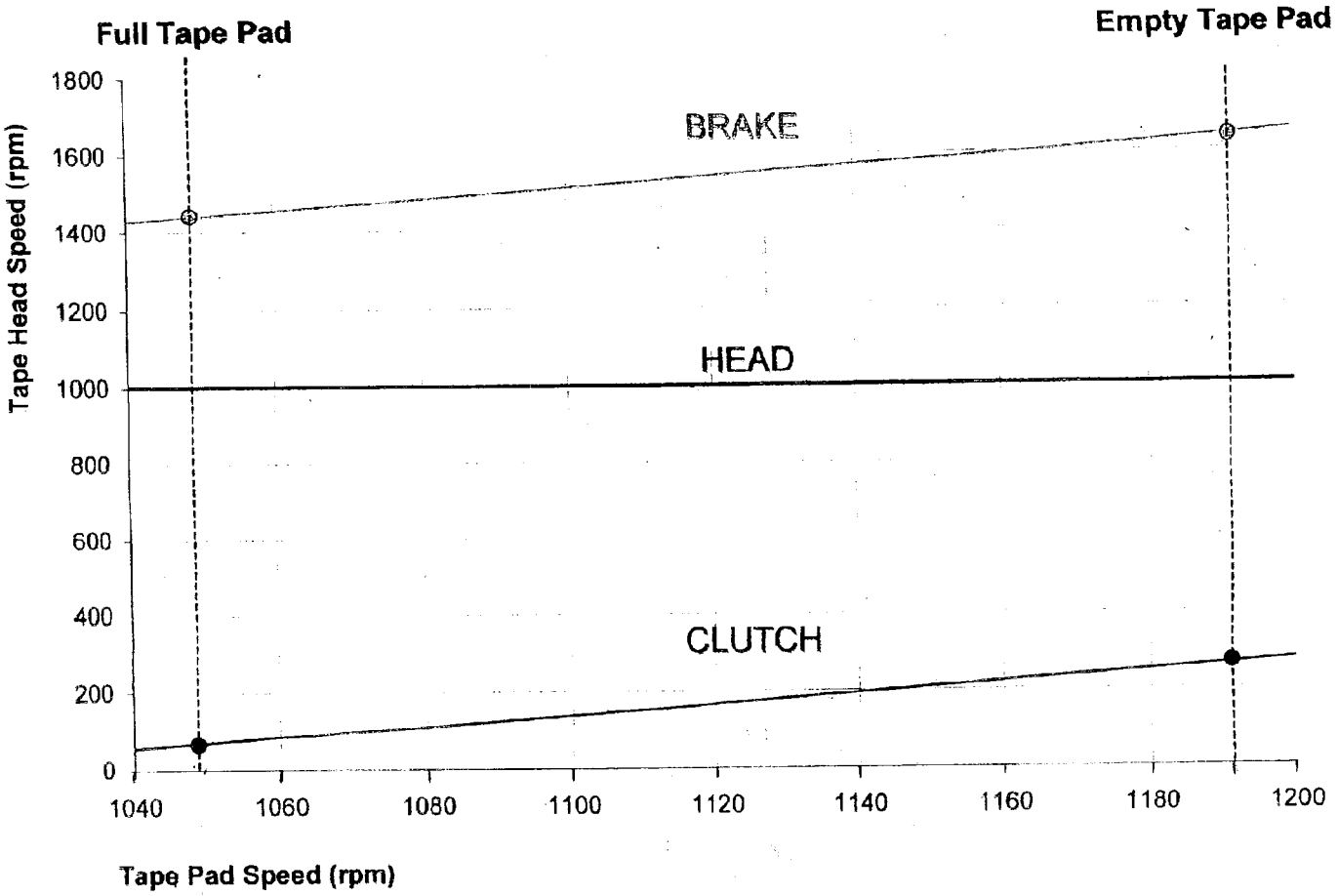
FIG. 3 is a graph comparing the rotational speeds of both a brake and a clutch in relation to the speed of the tape head as a function of the tape pad speed.

Referring to FIG. 3, the rotational speeds of the output shaft is shown for both a brake and a differential clutch of the type used with the present invention, for a constant rotational speed of the tape head 32 of 1000 rpm. The use of brakes, as in the conventional art, shows a variation from over 1400 rpm to almost 1600 rpm, as the tape pad transitions from a full tape pad to an empty tape pad. Thus, as the tape pad becomes depleted, and rotates at a faster speed, the rotation speed of the brake increases in order to maintain the tension in the tapes at a potentially constant speed.

Using the differential clutch in accordance with the invention, FIG. 3 illustrates that the rotational speed of output shaft 16" rotates over the range from less than 100 rpm to approximately 250 rpm over the same range of tape pad speeds as the tape pad transitions from a full tape to an empty tape pad. It will be evident, therefore, that there is an improvement from 6:1 when the tape head is empty to as much as approximately 20:1 when the tape head is full in the reduction in rotational speeds of the output shaft. This is a significant improvement and it results in substantially less heat losses.

Figure 5:
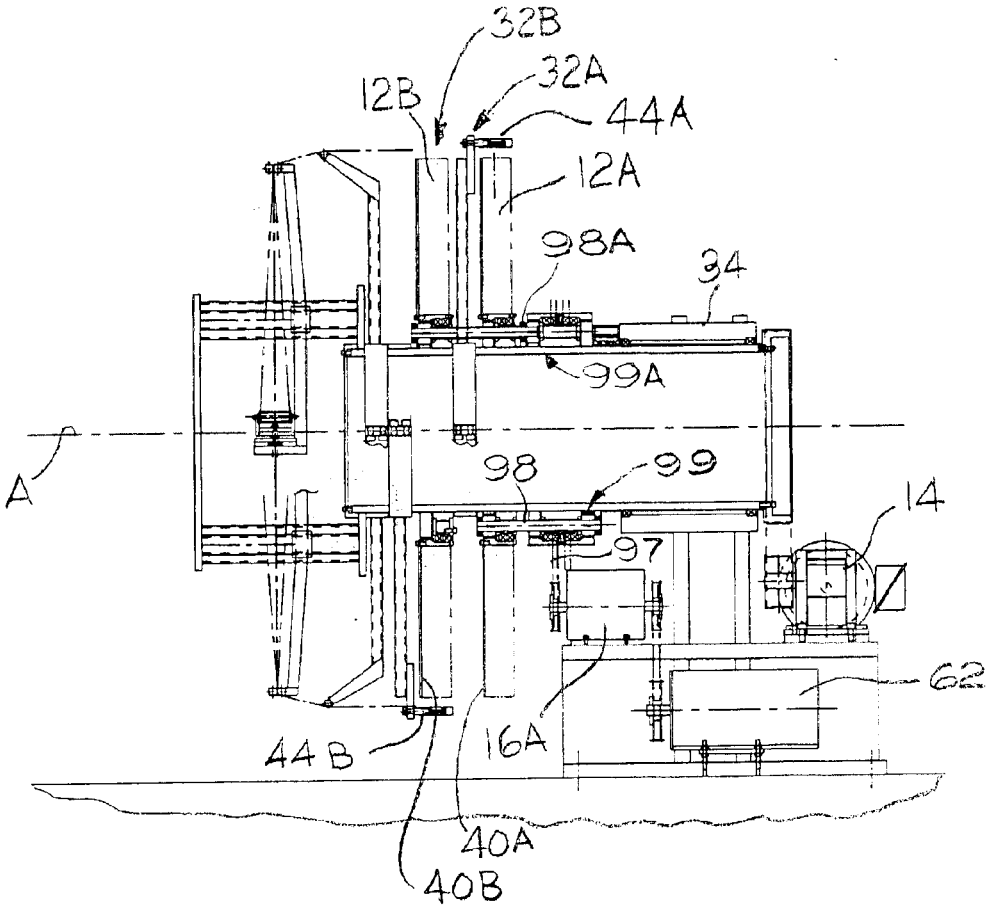
FIG. 5 is a side elevational view of the tape applicator shown in FIG. 4A.

Referring to FIGS. 4A, 4B, and 5, a preferred embodiment of the invention 60 is shown in which 2 tape pads 12A and 12B are shown arranged to simultaneously issue tape to be guided onto an elongate member moving through the support shaft along axis A. Because of the variations in tape pads 12A, 12B, different tensioning systems need to be provided for each of the tape pads to ensure optimum uniformity.

Thus, tape pads 12A, 121 are actually spaced from each other along axis A. Each of the tape pads is mounted for independent rotation on the support shaft by means of independent bearing systems, each of the tape pads being directly or indirectly coupled or linked to an associated clutch 16A, 16B respectively.

It should be noted that the tape pads generally occupy a predetermined axial region and the gearing or linking systems for each of the tape pads extends to a region beyond the axial region in which the tape pads are mounted. In the embodiment illustrated, the gearing elements are located upstream of the location where the tape pads are located in order to provide information regarding the rotational speeds of the tape pads. Consequently, by using a system 99 of pinion gears and bearings, a linking shaft 98 transmits the rotational speed of pad 12A to a gear that can be engaged by a belt 97. The same is true for pad 12B, which includes a system 99A linking shaft 8A that transmits the rotational speed information for tape pad 12B to system 99A (only partially shown) of pinion gears and bearings that can likewise be engaged by a suitable drive belt.

It should be evident that in this arrangement, main drive motor 14 is directly coupled to the rotating frame supporting related rotors 40A, 40B and tape rollers 44A and 44B for each of tape pads 12A, 12B. The main motor 14 is also directly coupled to the input shaft of the two differential clutches 16A 16B, while the rotating members in reflecting the rotational speeds of the individual tape packages or pads are linked, by means of suitable belts, to the output shafts of the differential clutches 16A, 16B as shown. It will be noted, therefore, that with this arrangement each of the tape pads 12A, 12B can operate potentially independently with a single main drive while individually, precisely, and simultaneously controlling the tension of the tape emanating from both of the tape pads.

In one preferred embodiment, a rewind drive motor 62 is provided for driving tape pads 12A, 12B, through their associate clutches, when the rewind drive is actuated. During normal operations, the drive motor 62 follows the main drive 14.

Figure 6:
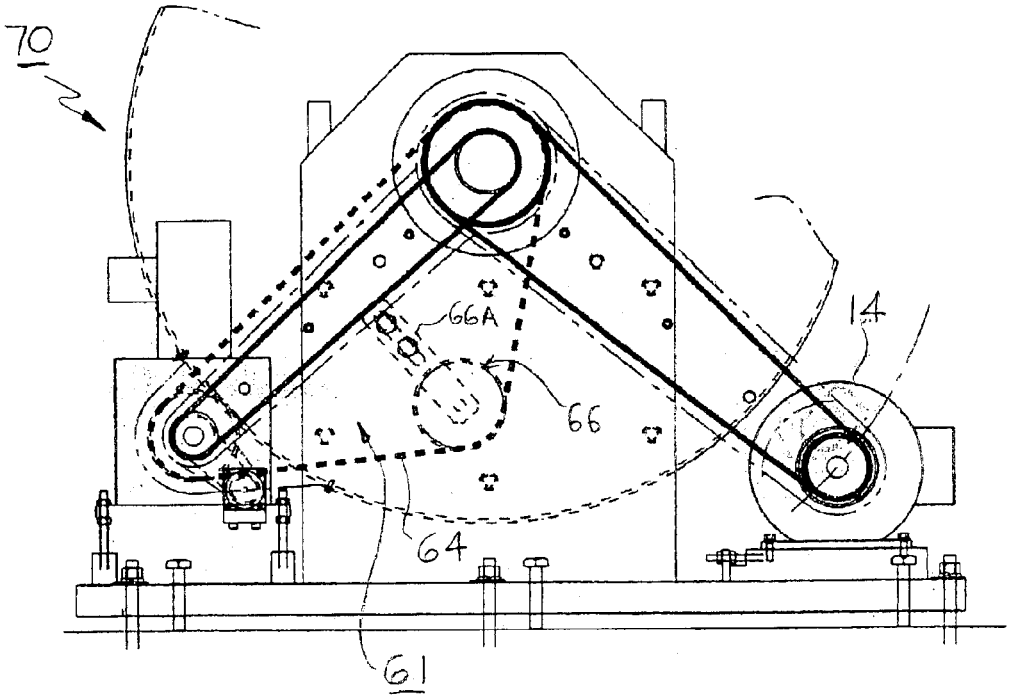
FIG. 6 is a front elevational view, partially fragmented, of a tape applicator in accordance with the invention similar to the one shown in FIG. 1, additionally showing a drive belt tensioning apparatus for tensioning one of the drive belts used in the tape applicator.

Referring to FIG. 6, in a preferred variation of the present invention, a tensioning mechanism 61 is combined with any of the previous embodiments commonly referred to for convenience as 70, and illustrated for tensioning a drive belt 64. Thus, for example, a sheave or pulley 66 may be slideably and fixably mounted on a frame 66A extending along the direction generally transverse to the directions of the belt. A sheave or pulley 66 is mounted to engage belt 64 and cause one-half of the belt to be stretched in one direction away from the other side of belt 64, thereby tensioning the belt. When the tension in belt 64 is to be reduced, for example to facilitate removal and replacement of belt 64, the sheave or pulley 66 can be moved closer towards the other side of belt 64 so as to loosen the tension placed upon belt 64. Such an arrangement may be used for any of the belts illustrated in the various embodiments.

Figure 8:
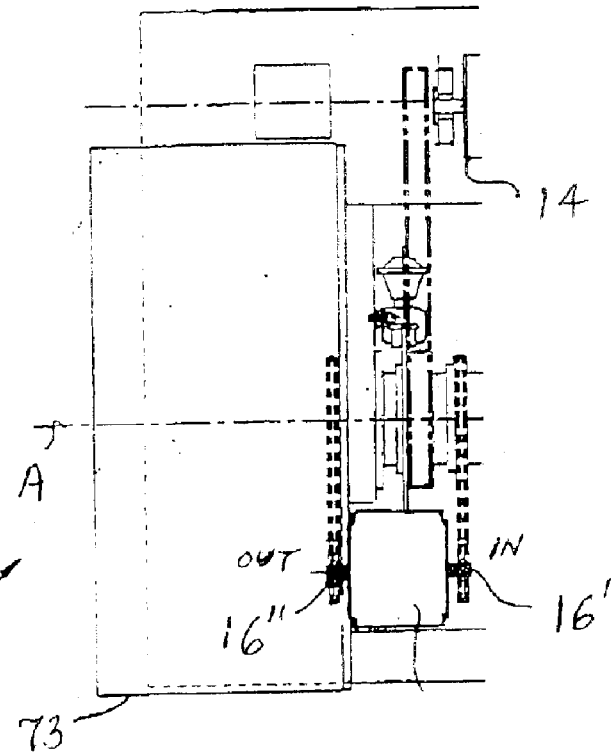
FIG. 8 is a top plan view of the tape applicator shown in FIG. 7.
Figure 7:
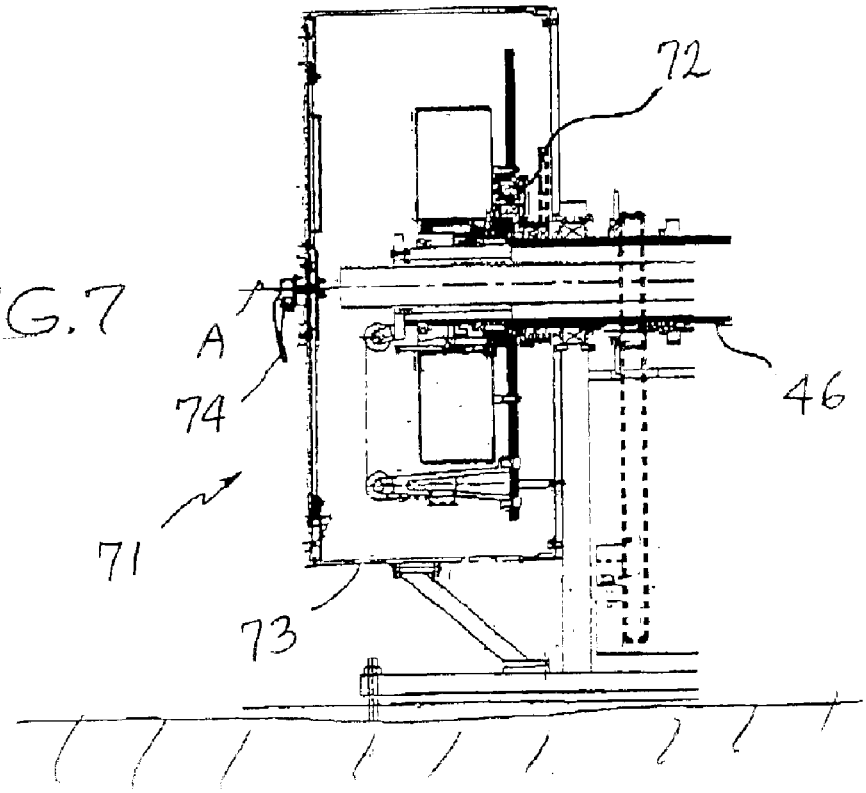
FIG. 7 is a side elevational view of a further embodiment in accordance with the present invention, in which a solid central shaft which requires a planetary system for advancing the tape along the outer surface of the rotating support shaft.

Referring now to FIGS. 7 and 8, a similar tape applicator is illustrated and designated by the reference designator 71. In this embodiment, the center of the structure is not available due to tape paths, and a planetary arrangement 72 is used to connect to the output shaft of the clutch 16. A shielding structure 73 protects planetary arrangement 72 accessed via a handle 74. However, irrespective of the path taken by the tape, the same coupling relationships aforementioned in connection with FIG. 1 and subsequent figures apprise equally to this embodiment in order to achieve the same or similar advantages or benefits.

The preceding description has been presented with reference to the presently preferred embodiments of the invention. Workers skilled in the art and technology to which this invention pertains will appreciate that alterations and changes in the described structure may be practiced without meaningfully departing from the principal, spirit, and scope of this invention. Accordingly, the foregoing description should not be read as pertaining to the precise structures described and illustrated in the accompanying drawings, but rather should be read consistent with and as support to the following claims that are to have their fullest and fair scope.

What is claimed is:

1. A concentric tape applicator comprising a support shaft defining an axis and including means for supporting a tape pad for rotation with said support shaft about said axis; guide means mounted on a said support shaft for rotation concentrically about said axis for guiding tape from the tape pad for application to an elongated member advancing along said axis relative to said support shaft; a drive means directly coupled to said guide means; a differential clutch having an input shaft directly coupled to said drive means and an output shaft coupled to said support shaft for applying braking forces to said pad; feedback means for sensing the speed of rotation of said pad and applying a feedback signal to said clutch to maintain a substantially uniform tension on the tape dispensed from the pad substantially independently of the amount of tape remaining in the pad.

2. A concentric tape applicator as defined in claim 1, wherein the support shaft has a moment of inertia lower than the moment of inertia of said guide means.

3. A concentric tape applicator as defined in claim 1, wherein the pad defines a plane generally normal to said axis and said guide means comprises a tape guide roller that is radically spaced from said path and rotates in a plane generally coextensive with the plane of said pad.

4. A concentric tape applicator as defined in claim 1, wherein said feedback means comprises an encoder having an input shaft directly coupled to said support shaft, and control means for providing a control signal to said differential clutch that is a function of the rotational speed of said support shaft to provide a degree of braking on said support shaft to maintain the tension on the tape.

5. A concentric tape applicator as defined in claim 4, wherein said control means comprises an electronic circuit.

6. A concentric tape applicator as defined in claim 1, wherein said means for supporting the tape pad is a direct contact in the face, whereby the rotational speed of said support shaft and the tape pad are the same under all operating conditions.

7. A concentric tape applicator as defined in claim 1, wherein said feedback means comprises an encoder having an input shaft directly coupled to said output shaft of said clutch, and control means for providing a control signal to said differential clutch that is a function of the rotational speed of said output shaft to provide a degree of braking of said support shaft to maintain the tension on the tape.

8. A concentric tape applicator as defined in claim 1, wherein said support shaft is provided with its own independent bearing system.

9. A concentric tape applicator as defined in claim 1, coupling to at least one of said differential clutch and to said drive is by means of a drive belt, and further comprising tensioning means for selectively tensioning at least one drive belt.

10. A concentric tape applicator comprising a support shaft defining an axis for rotation and including means for supporting a plurality of tape pads axially spaced from each other along said axis for rotation on said support shaft; guide means for each tape pad mounted on said support shaft for rotation concentrically about said axis for guiding tape from each of said tape pads for application to an elongated member advancing along said axis relative to said support shaft; drive means directly coupled to said guide means; a plurality of differential clutches one for each of said plurality of tape pads, each differential clutch having an input shaft directly coupled to said drive and an output shaft, said means for supporting the tape pads comprising at least one independent bearing system for at least one of said plurality of tape pads to allow for independent rotational speeds of each of the tape pads and defining a rotating member the rotational speed of which corresponds to the rotational speed of its associated tape pad, said output shaft of each clutch being coupled to said rotating member of an associated tape pad for applying braking forces to the pad; feedback means for sensing the speed of rotation of each taping pad and associated rotating member and applying a feedback signal to an associated clutch for maintaining a substantially uniform tension on a tape on an associated tape pad substantially independently of the amount of tape remaining on such tape pad.

11. A concentric tape applicator as defined in claim 10, wherein two or more tape pads are provided.

12. A concentric tape applicator as defined in claim 10, wherein said drive means comprises a single drive motor coupled to said support shaft.

13. A concentric tape applicator as defined in claim 10, wherein the tape pads are mounted within a predetermined axial region along said support shaft, and said rotating members associated with each tape pad are positioned outside of said predetermined axial region.

14. A concentric tape applicator as defined in claim 13, wherein said rotating members are located upstream of said predetermined axial region.

15. A concentric tape applicator as defined in claim 14, wherein said rotating members are mechanically coupled to associated tape pads.

16. A concentric tape applicator as defined in claim 15, wherein said rotating members are coupled to associated tape pads by means of bearing mounted gear trains.

17. A concentric tape applicator as defined in claim 10, wherein said rotating members are coupled to associated clutch output shafts by means of a pulley drive system.

18. A concentric tape applicator as defined in claim 10, further comprising a rewind drive means for rewinding tape onto tape pads when tape has been depleted.

19. A concentric tape applicator as defined in claim 18, further comprising a rewind clutch having an input shaft coupled to said rewind drive means and an output shaft coupled to said rotating members; and control means for activating said rewind clutch only when the rewind function is selected and driven at a speed proportional to the main drive during normal taping operation.

* * * * *